United States Patent [19]

Lovin

[11] Patent Number: 4,535,989

[45] Date of Patent: Aug. 20, 1985

[54] SAND TRAP PRACTICE DEVICE

[76] Inventor: Arthur Lovin, 2609 Petaluma Ave., Long Beach, Calif. 90815

[21] Appl. No.: 617,960

[22] Filed: Jun. 7, 1984

[51] Int. Cl.[3] ..... A63B 69/36

[52] U.S. Cl. ..... 273/176 FB; 273/195 R; 273/176 B; 206/575; 206/315.1

[58] Field of Search ..... 206/823, 315.1, 408, 206/409, 410; 273/195 R, 176 F, 176 FA, 176 FB, 32 R, 35 R, 35 B; 119/15

[56] References Cited

U.S. PATENT DOCUMENTS

| | | | |
|---|---|---|---|
| 2,637,439 | 5/1953 | Banks | 206/823 X |
| 3,025,059 | 3/1962 | Di Buono | 273/32 R |
| 3,735,988 | 5/1973 | Palmer et al. | 273/178 B |
| 3,936,055 | 2/1976 | Scott | 273/176 H |
| 4,286,710 | 9/1981 | Higgins | 206/575 X |

*Primary Examiner*—George J. Marlo
*Attorney, Agent, or Firm*—Klein & Szekeres

[57] ABSTRACT

Apparatus for the practice of sand trap golf shots comprises a tray of substantially uniform depth and a sheet of foldable material. The sheet, when folded, is fully containable within the tray. When unfolded, the sheet has an exterior portion which extends over the sides of the tray to form an apron around the tray's perimeter, and an interior portion which forms a lining for the inside of the tray. The tray, with its lining, is filled with sand, or a suitable substitute. A golfer can then practice hitting balls out of the sand. The sand scattered by the golfer's swings falls on the apron, which can then be lifted over the tray to return the sand to the tray's interior. When the apparatus is not in use, the sheet is simply folded up over the sand, thereby protecting the sand from the elements. A golf shot aiming device is advantageously included in the apparatus. The aiming device comprises a pair of perpendicular panels, and it can be partially embedded in the sand with one of the panels protruding to provide a guide or a target for aligning or aiming a golf shot.

14 Claims, 6 Drawing Figures

SAND TRAP PRACTICE DEVICE

BACKGROUND OF THE INVENTION

This invention relates generally to the field of devices for use in practicing golf shots. More particularly, it relates to golf shot practice devices which provide portable or semi-portable golfing surfaces, and which allow the practice of sand trap or "bunker" shots.

Golf is a game in which much practice is required to achieve a satisfactory degree of proficiency. Many golfers, accordingly, seek to practice or perfect their games at every opportunity. Thus, a large number of devices have been developed to allow golfers to practice various aspects of their games while away from a golf course, and even in their homes.

One class of such golf practice devices is the type of device which provides a portable or semi-portable surface which simulates one or more of the different types of playing surfaces of an actual golf course. Examples of this class of device are disclosed in U.S. Pat. No. 3,735,988 to Palmer, et al., and U.S. Pat. No. 3,936,055 to Scott. The devices disclosed in these patents provide simulated putting green and fairway surfaces which can be moved about without undue difficulty. These devices, however, do not provide any means for simulating a sand trap or "bunker".

Thus, the golfer who desires to practice sand trap shots is left with little in the way of convenient practice devices. U.S. Pat. No. 3,025,059 to DiBuono discloses a device which allows one to practice sand trap shots. The DiBuono device, however, is a relatively massive apparatus designed for a permanent or semi-permanent installation, and thus cannot be used within the relatively confined spaces of the average home or residential yard.

Therefore, it would be highly advantageous to provide a golf shot practice device which allows the practice of sand trap shots within the golfer's home or yard. To this end, such a device should be portable or semi-portable, and it should also provide some means for minimizing the mess from scattered sand which results from these shots.

SUMMARY OF THE INVENTION

Broadly, the present invention comprises a tray containing a sheet of foldable material. When unfolded, the sheet extends over the sides of the tray to form an apron around the tray's perimeter, with the portion of the sheet remaining inside the tray forming a lining for the tray's interior. The tray, with its lining, is adapted to be filled with sand, or some other suitable particulate material, which can be used to simulate sand. Thus, a person can hit a golf ball out of the sand, and the scattered sand resulting from the shot will land on the exterior apron. When practice is finished, the user can then simply fold the sheet back up inside the tray, the sand on the apron portion being neatly returned to the interior of the tray as the sheet is folded.

The invention advantageously includes a golf shot aiming or guiding device which can be partially embedded in the sand, with a guiding or aiming surface extending upwardly through the sand's surface. The guiding or aiming surface can be oriented to act either as a guide for aligning the golfer's stance and club, or as a target over which a user would aim in shooting the ball out of the sand. In its preferred form, the aiming device comprises a pair of perpendicular planar members, with one of the members being substantially longer than the other, so as to be approximately "L"-shaped in cross-section. If the device is embedded with the shorter member protruding through the sand and aligned parallel to the desired direction of the golfer's swing, it acts as a guiding surface. If the device is oriented with either the shorter or longer member protruding through the sand transversely to the direction of the swing, it provides an aiming surface over which the golfer must direct the shot.

The entire practice apparatus, including the tray, the sheet, and the aiming device, can be made in dimensions which allow the apparatus to be at least semi-portable, even when filled with sand.

Thus, as will be more fully appreciated from the detailed description which follows, the present invention allows a golfer to practice sand trap shots conveniently while away from the golf course, using a device which can be transported from place to place. Moreover, the device can even be used indoors (with practice golf balls of suitable plastic or foam material) without a mess resulting from scattered sand. Furthermore, the invention, including the aiming device, provides the golfer with an effective aid in the practice and perfection of sand trap shots.

DETAILED DESCRIPTION OF THE INVENTION

Figure 2:
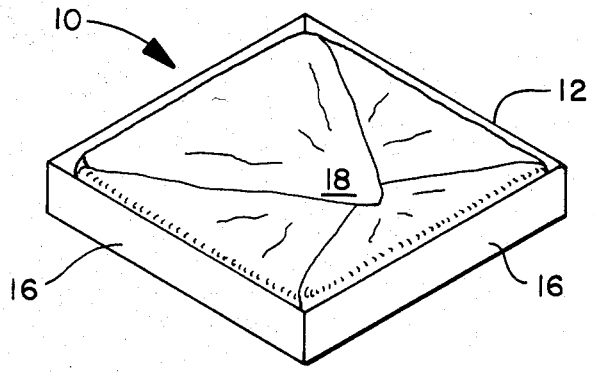
FIG. 2 is a perspective view of the present invention, showing the invention in its storage mode.
Figure 1:
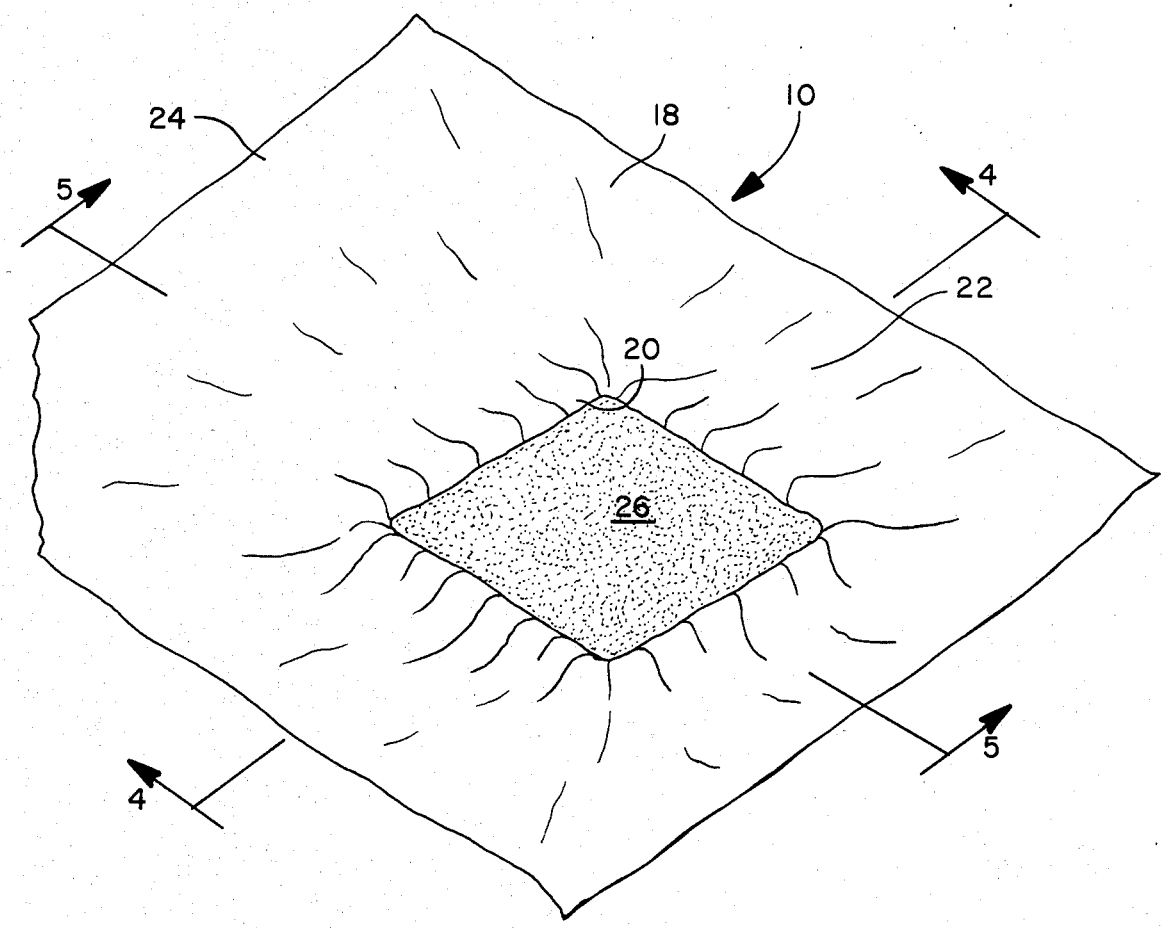
FIG. 1 is a perspective view of a preferred embodiment of the present invention, showing the invention in its playing mode.

Referring first to FIGS. 1 and 2, a sand trap practice device 10, in accordance with a preferred embodiment of the present invention, is shown. In FIG. 1, the device 10 is shown in its playing mode; in FIG. 2, in its storage mode. As best shown in FIG. 2, the device includes a tray 12 having a flat bottom 14 (FIGS. 4, 5, and 6) and vertical side walls 16. The preferred shape for the tray 10 is square or rectangular, although other shapes can be used as well. In the tray's rectangular embodiment, its horizontal dimensions are advantageously from about 2 feet by 3 feet to about 2.5 feet to 3.5 feet. The tray can be made larger, if desired, but at the expense of portability. The depth of the tray should be uniform, and preferably in the range of about 3 to 4 inches. A rigid plastic material (such as polyvinyl chloride, for example) is a preferred material for the tray. The material of the tray should be thick enough and strong enough to support the weight of the material contained in the tray, as described below, as well as to withstand the stresses of an adult human standing in the tray's interior.

Contained within the tray 12 is a sheet 18 of a strong, pliable, foldable material. While the sheet 18 can be made of a strong cloth, such as canvas, a suitable plastic is preferred, to minimize weight, and for ease of cleaning and maintenance. For a rectangular tray with dimensions in the range given above, the sheet 18 should be rectangular, with preferred dimensions in the range of about 5 to 6 feet by 6 to 7 feet.

In actuality, the sheet 18 is fully contained within the tray 12 only when the practice device 10 is in its storage mode, as will be described below, with the sheet 18 folded up, as shown in FIG. 2. When the device is in its playing mode (FIG. 1), the sheet 18 has an interior portion 20 which forms a lining for the interior of the tray 12, and an exterior portion which extends over the sides 16 of the tray to form an apron 22 around the tray's perimeter. As shown in FIG. 1, the sheet 18 is preferably arranged so that the apron 22 has one side 24 which extends farther out from the tray than do the other sides of the apron, the advantage of this arrangement being described below. The sheet 18 may, optionally, be removably attached to the inside of the tray by suitable attachment means (not shown).

As best seen in FIG. 1, the tray 12, with its lining 20, is adapted to be filled with a quantity of sand 26, preferably as a layer spread evenly throughout the tray. Although sand is preferred, other particulate materials which closely simulate sand may be found to be suitable.

In the playing mode of the invention (FIG. 1), a golfer stands in the tray and hits golf balls out of the sand layer. In using the preferred embodiment shown in FIG. 1, with the apron 22 having the one extended side 24, the golfer stands so as to swing toward the extended side 24. Since most of the sand scattered as a result of the shot travels in the same direction as the golfer's swing, the larger apron area provided by the extended side 24 is available to catch the bulk of the scattered sand. Sand scattered in other directions will land on the other areas of the apron 22.

When the golfer is finished practicing, the apron 22 is lifted over the tray 12 so that the sand which has fallen on the apron 22 is returned to the tray. The practice device may then be returned to its playing mode, or the device may be placed in its storage mode by neatly folding the sheet 18 completely to enclose the sand within the tray 12, as shown in FIG. 2. With the device in its storage mode, it may be transported from place to place without spilling the sand. The use of a sheet made of a waterproof material, such as a suitable plastic, will protect the sand from the elements, thereby allowing the practice device to be stored outdoors.

Figure 3:
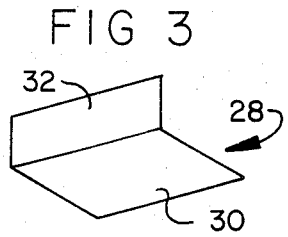
FIG. 3 is a perspective view of a preferred embodiment of the aiming device used in the present invention.

Turning now to FIG. 3, an aiming or guiding device 28 advantageously used with the present invention is shown. The aiming device 28 preferably comprises a pair of planar members 30,32 joined at a right angle so as to present an "L" shape in cross-section. In this configuration, one planar member (e.g. member 30) is substantially longer than the other member (e.g. member 32), as measured from their juncture. As a specific example of an aiming device 28, the member 30 is approximately 8 inches long; the member 32 is approximately 4 inches long; and both members have a width of approximately 12 inches. The longer member is thus, preferably, at least twice as long as the shorter member. The preferred material for the aiming device 28 is a rigid plastic, such as polyvinyl chloride, although a metal (e.g. aluminum) can also be used.

Figure 4:
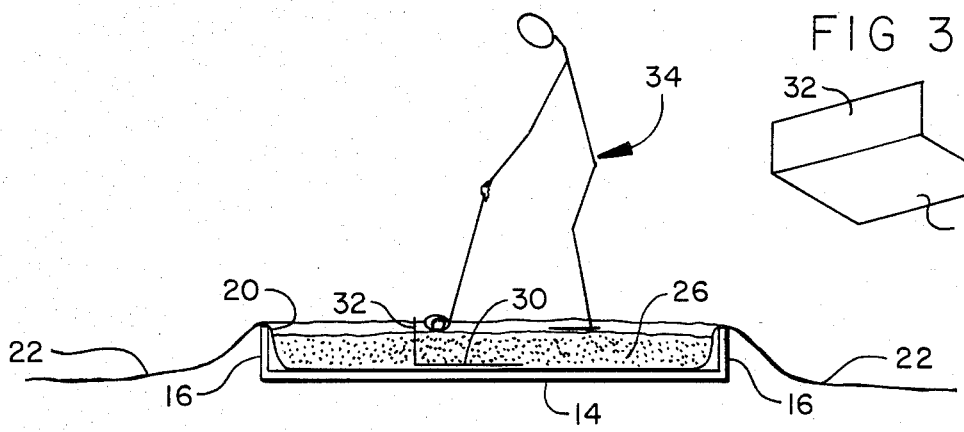
FIG. 4 is a cross-sectional view taken along line 4—4 of FIG. 1, and showing the aiming device of FIG. 3 used as a guide.
Figure 5:
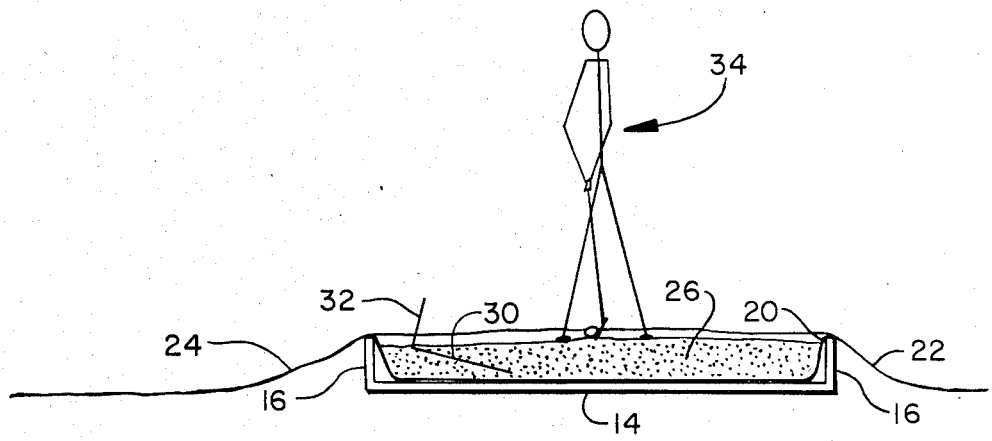
FIG. 5 is a cross-sectional view along line 5—5 of FIG. 1, showing the aiming device of FIG. 3 used as a low target over which the golfer would aim to shoot the ball out of the trap.
Figure 6:
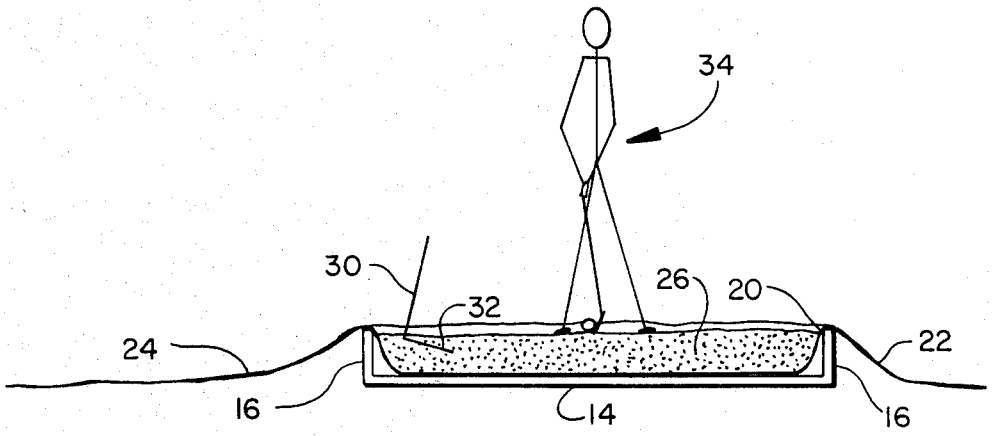
FIG. 6 is a cross-sectional view, similar to FIG. 5, showing the aiming device oriented as a high target.

The use of the aiming device 28 is illustrated in FIGS. 4, 5, and 6. In FIG. 4, the aiming device is partially embedded in the sand layer 26 so that a portion of the shorter planar member 32 protrudes above the surface of the sand. The aiming device is oriented to be substantially parallel with the direction of the swing of a golfer 34, so that the aiming device 28 acts as a guide for aligning the golfer's swing. The golfer would thus practice taking straight swings, using the shorter member 32 as an alignment aid.

In FIGS. 5 and 6, the use of the aiming device 28 as a target is illustrated. In FIG. 5, the aiming device 28 is partially embedded in the sand 26 so that most of its shorter member 32 is protruding from the sand. The aiming device is oriented so that the member 32 extends substantially perpendicular to the golfer's direction of swing, with the member 32 being angled slightly toward the golfer. In FIG. 6, the placement and orientation of the aiming device is similar, except that it is the longer member 30 which protrudes through the sand's surface. In either case, the protruding member of the aiming device 28 presents a target or obstacle over which the golfer must hit the ball.

If the length of the shorter member 32 of the aiming device 28 is no greater than the depth of the tray 12, the aiming device may be placed flat on the surface of the sand 26 with the shorter member extending downwardly, so that the aiming device can be enclosed within the sheet 18 when the practice device is in its storage mode (FIG. 1).

There has thus been described a golf shot practice device which allows a golfer to practice sand trap shots conveniently while at home or otherwise away from the golf course. The device is conveniently stored and transported when not in use, and, when used, it minimizes the mess created by sand scattered by the golfer's swing. When the aiming device is used, the golfer is further aided in the development of a correct swing for successful play from a sand trap.

While a preferred embodiment of the invention has been shown and described, it will be appreciated that variations from the precise structure of this embodiment will suggest themselves to those skilled in the pertinent arts. Therefore, the preferred embodiment should be considered an exemplary form of the present invention, the scope of which is defined in the claims which follow.

What is claimed is:

1. Apparatus for the practice of golf shots, comprising:

a tray having a planar bottom and substantially vertical sides, the horizontal dimensions of said tray being large enough to allow a person to stand in said tray and swing a golf club therein, and the height of said sides being small relative to the horizontal dimensions of said tray;

a sheet of foldable material contained in said tray, said sheet, when unfolded, having (a) an exterior portion extending over said sides and outwardly therefrom to form an apron around said tray, and (b) an interior portion forming a lining for the inside of said tray, said interior portion adapted to contain a layer of particulate material; and golf shot aiming means, comprising first and second substantially perpendicular planar members;

whereby, when said interior portion of said sheet is filled with a layer of particulate material, said golf shot aiming means is partially embeddable in said layer of particulate material, with one of said planar members protruding from said layer to form a guide for a person hitting a golf ball out of said layer of particulate material, said apron extending outwardly from at least one of said sides a sufficient distance to catch a substantial amount of the particulate material scattered from said interior portion toward said one side as a result of a person swinging a golf club into said particulate material.

2. The apparatus of claim 1, wherein said exterior portion of said sheet extends farther outwardly from one side of said tray than it does from the other sides.

3. The apparatus of claim 1, wherein said tray is substantially rectangular and includes four substantially vertical side walls, and wherein said sheet is substantially rectangular and extends farther outwardly from one of said side walls than it does from the other three side walls.

4. The apparatus of claim 1, wherein said first and second planar members of said aiming means are of unequal lengths as measured from their juncture.

5. The apparatus of claim 4, wherein said first planar member is approximately twice the length of said second planar member, as measured from their juncture.

6. The apparatus of claim 1, wherein said sheet is made of a waterproof plastic material.

7. Apparatus for the practice of golf shots, comprising:

a tray of substantially uniform depth and having substantially vertical sides, the horizontal dimensions of said tray being large enough to allow a person to stand in said tray and swing a golf club therein, the height of said sides being small relative to the horizontal dimensions of said tray;

a sheet of foldable material fully containable in said tray when folded, and having, when unfolded, (a) an exterior portion extending over said sides and outwardly therefrom to form an apron around the outside perimeter of said tray, and (b) an interior portion forming a lining for the inside of said tray; and a layer of particulate material contained in said interior portion of said sheet;

said apron having a plurality of sides, each of said sides of said apron extending outwardly from one side of said tray a distance sufficient to catch a substantial amount of said particulate material which is scattered from the interior of said tray over each side thereof as a result of a person swinging a golf club into said particulate material, one of said sides of said apron extending outwardly from said tray farther than do the other sides of said apron.

8. The apparatus of claim 7, wherein said sheet, when unfolded, and said tray, are substantially rectangular.

9. The apparatus of claim 7, wherein said particulate material is sand.

10. The apparatus of claim 7, further comprising:

golf shot aiming means, comprising first and second substantially perpendicular planar members, said aiming means being partially embeddable in said layer of particulate material, with one of said planar members protruding from said layer to form a guide for a person hitting a golf ball out of said particulate material.

11. The apparatus of claim 10, wherein said golf shot aiming means is substantially "L"-shaped in cross-section.

12. The apparatus of claim 11, wherein said first and second planar members of said golf shot aiming means are of unequal lengths, as measured from their juncture.

13. The apparatus of claim 12, wherein said first planar member has a length which is no greater than the depth of said tray, and wherein said second planar member has a length which is approximately twice the length of said first planar member.

14. The apparatus of claim 7, wherein said sheet is made of a waterproof plastic material.

* * * * *